US008555794B2

(12) United States Patent
Tamura

(10) Patent No.: US 8,555,794 B2
(45) Date of Patent: Oct. 15, 2013

(54) CASING

(75) Inventor: Tetsuya Tamura, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/062,992

(22) PCT Filed: Jul. 5, 2010

(86) PCT No.: PCT/JP2010/061405

§ 371 (c)(1), (2), (4) Date: Mar. 9, 2011

(87) PCT Pub. No.: WO2011/061962

PCT Pub. Date: May 26, 2011

(65) Prior Publication Data

US 2012/0234215 A1 Sep. 20, 2012

(30) Foreign Application Priority Data

Nov. 18, 2009 (JP) ..... 2009-262649

(51) Int. Cl.
*E04B 2/02* (2006.01)

(52) U.S. Cl.
USPC ..... 109/80; 109/49.5; 109/78; 109/82; 109/84

(58) Field of Classification Search
USPC ..... 109/49.5, 78, 80, 82–84
See application file for complete search history.

(56) References Cited

U.S. PATENT DOCUMENTS

| | | | | | |
|---|---|---|---|---|---|
| 6,655 | A * | 8/1849 | Hall | 109/83 |
| 530,410 | A * | 12/1894 | Giessler | 49/400 |
| 1,376,839 | A * | 5/1921 | Strauss | 109/83 |
| 1,554,395 | A * | 9/1925 | Young | 160/352 |
| 2,750,902 | A * | 6/1956 | McClellan | 109/81 |
| 3,123,025 | A * | 3/1964 | Fugelstad | 109/83 |
| 3,645,216 | A * | 2/1972 | Radford et al. | 109/82 |
| 3,826,172 | A * | 7/1974 | Dawson | 89/36.02 |
| 4,198,454 | A * | 4/1980 | Norton | 428/117 |
| 4,389,948 | A * | 6/1983 | Sands et al. | 109/82 |
| 4,455,801 | A * | 6/1984 | Merritt | 52/309.9 |
| 4,559,881 | A * | 12/1985 | Lankard et al. | 109/83 |
| 4,727,789 | A * | 3/1988 | Katsanis et al. | 86/50 |
| 4,765,254 | A * | 8/1988 | Goldman | 109/85 |
| 5,149,910 | A * | 9/1992 | McKee | 89/36.02 |
| 5,257,583 | A * | 11/1993 | Koenig | 109/49.5 |
| 5,360,129 | A * | 11/1994 | Lee | 220/1.5 |
| 5,390,580 | A * | 2/1995 | Gibbons et al. | 86/50 |
| 5,469,796 | A * | 11/1995 | Koenig | 109/49.5 |
| 5,660,021 | A * | 8/1997 | Wolgamot et al. | 52/783.12 |
| 6,119,411 | A * | 9/2000 | Mateu et al. | 52/79.1 |
| 6,273,007 | B1 * | 8/2001 | Alizade | 109/49.5 |
| 6,543,371 | B1 * | 4/2003 | Gardner | 109/83 |
| 6,736,473 | B2 * | 5/2004 | Cleveland et al. | 312/409 |
| 7,926,407 | B1 * | 4/2011 | Hallissy et al. | 89/36.02 |
| 2013/0036952 | A1 * | 2/2013 | Hughes, Jr. | 109/80 |

* cited by examiner

FOREIGN PATENT DOCUMENTS

| | | |
|---|---|---|
| JP | 2001-336323 A | 12/2001 |
| JP | 2002-147118 A | 5/2002 |
| JP | 2004-076387 A | 3/2004 |

*Primary Examiner* — Suzanne Barrett
(74) *Attorney, Agent, or Firm* — Rabin & Berdo, P.C.

(57) ABSTRACT

The fusion of a side wall may be made difficult by using a fusion-resistant material having light weight. Provided is a casing including a side wall having a multi-layer structure. In the casing, the side wall includes an outer wall, a fusion-resistant material provided at an inner side of the outer wall with a predetermined gap with respect to the outer wall, and an inner wall provided at an inner side of the fusion-resistant material with a predetermined gap with respect to the fusion-resistant material.

14 Claims, 8 Drawing Sheets

CASING

TECHNICAL FIELD

The invention relates to a casing, and particularly, to a crime preventive casing against fusion destruction.

BACKGROUND ART

Conventionally, as a crime preventive casing against fusion destruction, there are known a casing formed of a thick general steel plate, a casing formed by laminating metal plates such as a stainless steel plate having a melting point higher than that of a general steel plate or an aluminum plate or a copper plate having high thermal conductivity, a casing having a noncombustible material such as sands or ceramics disposed between metal plates, and the like. Further, there is known a casing that improves a crime preventive performance by installing a protector, formed of a fusion-resistant alloy specifically manufactured by a safe manufacture, around a device (refer to Japanese Patent Application Laid-Open (JP-A) No. 2004-76387).

DISCLOSURE OF THE INVENTION

Problems to be Solved by the Invention

However, in the above-described conventional crime preventive casing, there are problems in that the weight or volume of the device and the installation space significantly increase, and thus the manufacturing cost thereof increases.

Therefore, the invention is made in view of such circumstances, and an object of the invention is to provide a novel and improved casing capable of making fusion of a side wall difficult by using a fusion-resistant material having light weight.

Means for Solving the Problems

In order to solve the problem, according to an aspect of the present invention, there is provided a casing including a side wall having a multi-layer structure, wherein the side wall includes: an outer wall; and a fusion-resistant material provided at an inner side of the outer wall with a predetermined gap with respect to the outer wall.

The casing may include an inner wall provided at an inner side of the fusion-resistant material with a predetermined gap with respect to the fusion-resistant material.

The fusion-resistant material may be formed of a heat insulating material.

The fusion-resistant material may be bent in a cross-sectional shape.

The inner wall may be formed with a protrusion coming into contact with the fusion-resistant material.

The casing may be provided with a plural pins on the inner side of the outer wall so as to come into contact with the fusion-resistant material, and the fusion-resistant material is bent between the plurality of pins and the inner wall.

The side wall may be provided at both side surfaces of the casing.

The fusion-resistant material may be attachably and detachably provided in the casing, and the fusion-resistant material provided in one side wall of the casing may be removed to be provided at the other side wall of the casing.

The inner wall may be attachably and detachably provided in the casing, and the inner wall provided at one side wall of the casing may be removed to be provided at the other side wall of the casing.

The casing may be used for an automatic transaction machine.

Effects of the Invention

As described above, according to the invention, the fusion of the side wall may be made difficult by using the fusion-resistant material having light weight.

BEST MODE FOR CARRYING OUT THE INVENTION

Figure 1:
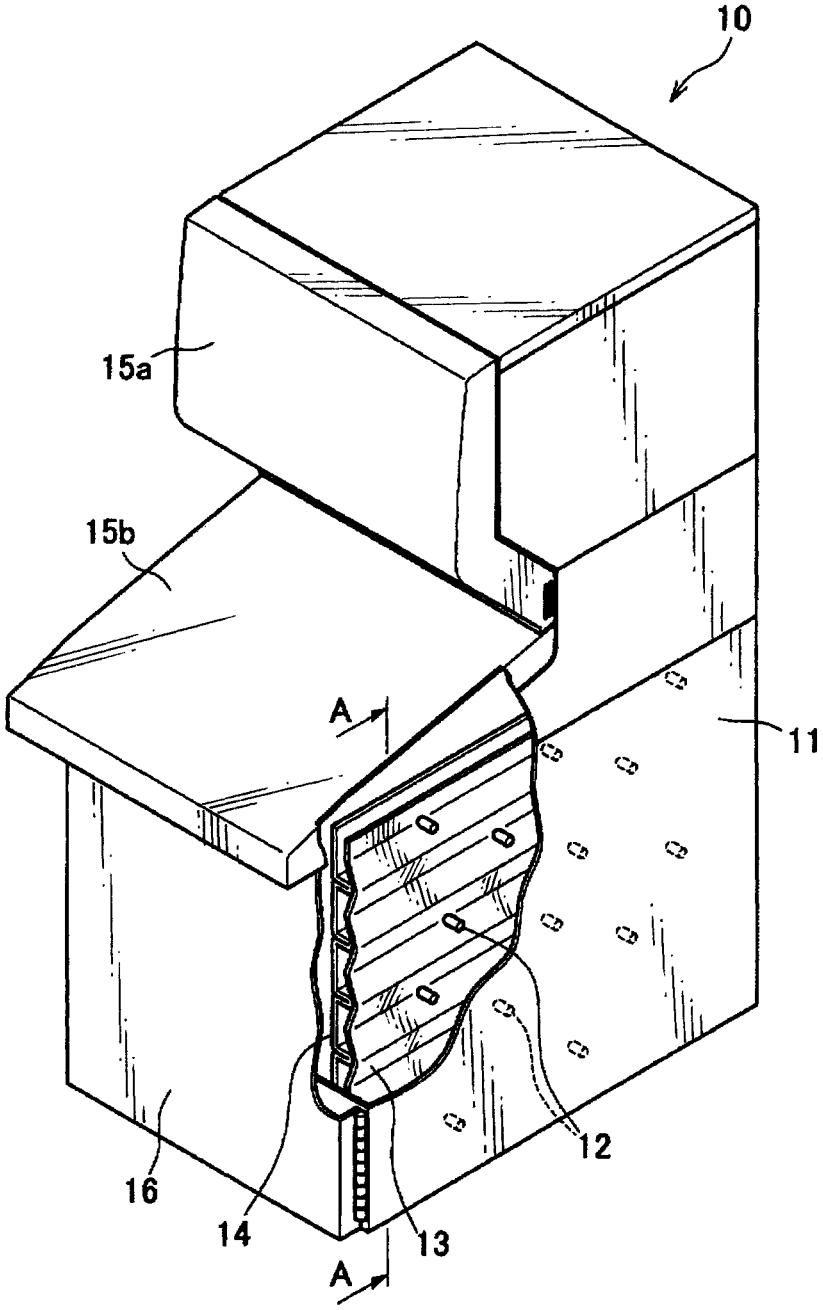
FIG. 1 is a perspective view schematically illustrating an external shape of a casing according to a first exemplary embodiment of the invention.

Hereinafter, exemplary embodiments of the invention will be described in detail by referring to the accompanying drawings. Further, in the specification and the drawings, since the same reference numerals are given to the components substantially having the same function and configuration, the description thereof will not be repeated.

Further, "Best Mode for Carrying Out The Invention" will be described in accordance with the procedures below.

(1) Object of exemplary embodiment
(2) First exemplary embodiment
(2-1) Configuration of casing
(2-2) Outline of automatic transaction system
(3) Second exemplary embodiment
(3-1) Configuration of casing

(1) Object of Exemplary Embodiment

First, an object of the exemplary embodiment will be described. Conventionally, as a crime preventive casing against fusion destruction, there are known a casing formed of a thick general steel plate, a casing formed by laminating metal plates such as a stainless steel plate having a melting point higher than that of a general steel plate or an aluminum plate or a copper plate having high thermal conductivity, a casing having a noncombustible material such as sands or ceramics disposed between metal plates, and the like. Further, there is known a casing that improves a crime preventive performance by installing a protector, formed of a fusion-resistant alloy specifically manufactured by a safe maker, around a device.

However, in the above-described conventional crime preventive casing, there are problems in that the weight or volume of the device and the installation space significantly increase, and thus the manufacturing cost thereof increases. Therefore, in view of the above-described circumstances, a casing 10 according to the exemplary embodiments of the invention is made. According to the casing 10 of the exemplary embodiments, the fusion of the side wall may be made difficult by using the fusion-resistant material having light weight. The casing 10 may be used as a safe requiring a crime preventive countermeasure or an automatic transaction machine storing cash or the like.

Hereinafter, an example will be described in which the casing 10 is used as an automatic teller machine (ATM) of a bank, but the invention is not limited to the example. For example, the casing may be used as an automatic transaction machine such as a CD, a money-changing machine, a vending machine, and a settlement machine. Further, the automatic transaction machine is installed in various facilities such as an office of a financial institution, a convenience store, a station yard, a hotel, a hospital, an amusement park, a restaurant, and an office building.

(2) First Exemplary Embodiment (2-1) Configuration of Casing

Figure 2:
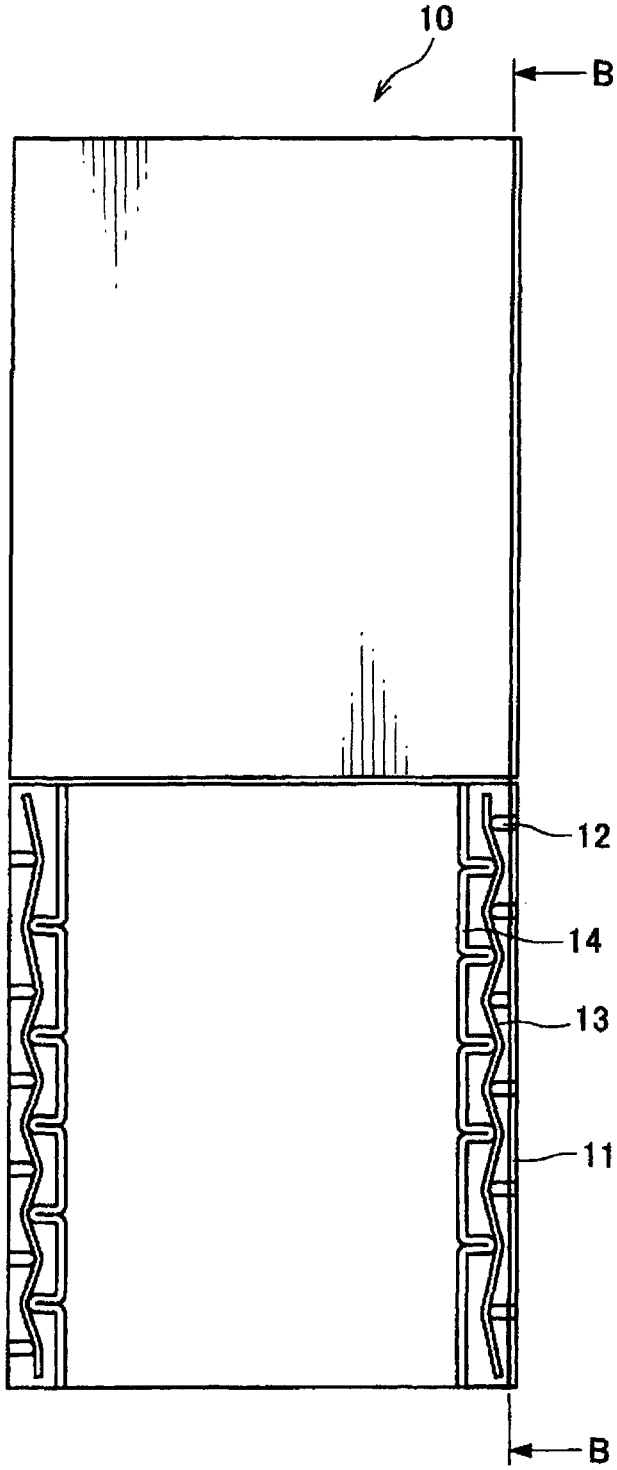
FIG. 2 is a cross-sectional view taken along the line A-A of FIG. 1 of the first exemplary embodiment.
Figure 3:
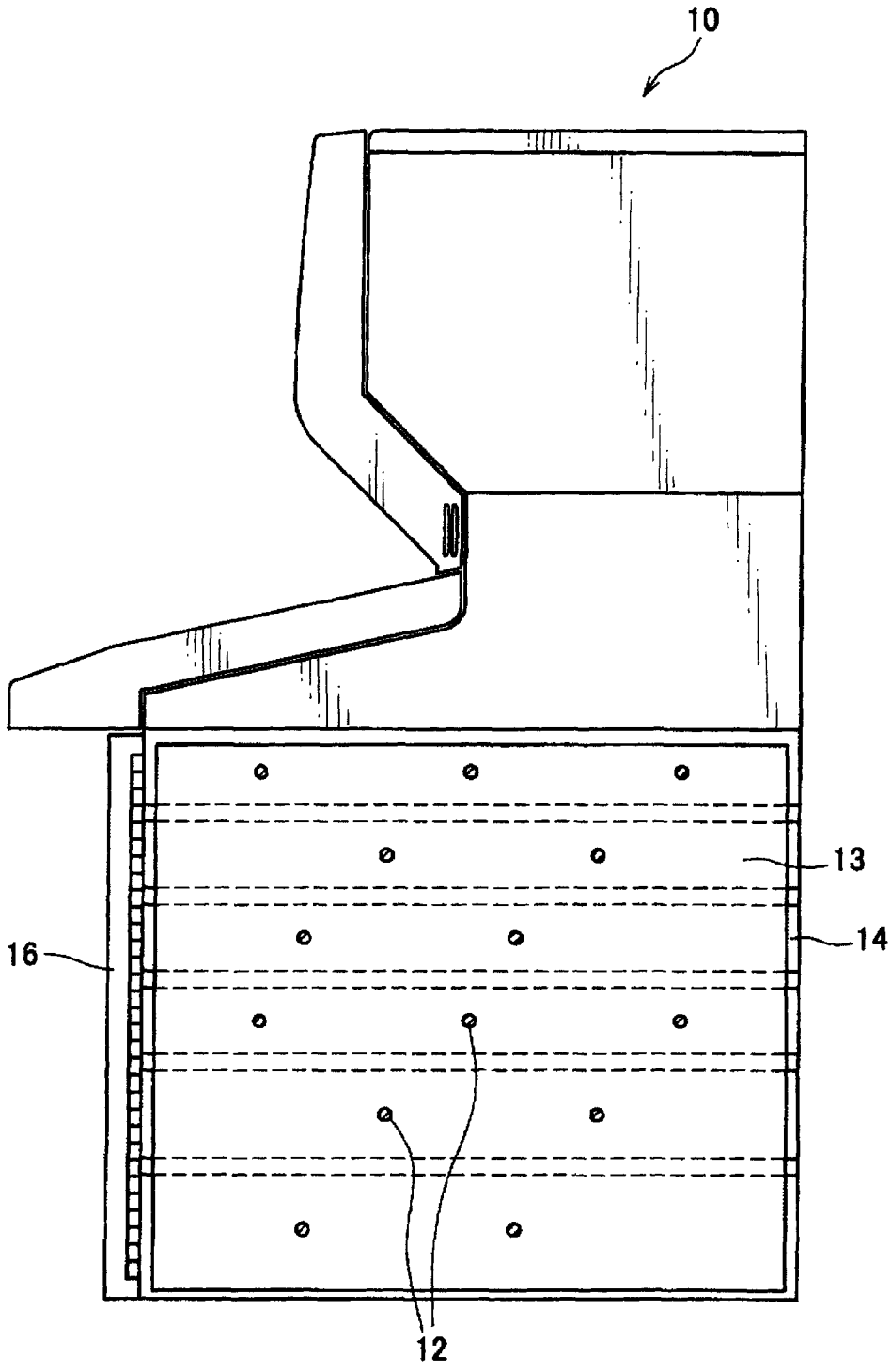
FIG. 3 is a cross-sectional view taken along the line B-B of FIG. 2 of the first exemplary embodiment.

Next, the detailed configuration of the casing 10 will be described by referring to FIG. 1. FIG. 1 is a perspective view schematically illustrating an external shape of the casing 10. Further, FIG. 2 is a cross-sectional view taken along the line A-A of FIG. 1, and FIG. 3 is a cross-sectional view taken along the line B-B of FIG. 2.

As shown in FIG. 1, the casing 10 mainly includes a side wall 11, operation panels 15*a* and 15*b*, a front door 16, and the like. The side wall 11 is provided at the side surface of the casing 10, and in the exemplary embodiment, the side wall 11 is provided at both side surfaces of the casing 10. Further, in the exemplary embodiment, the side wall 11 is formed as a multi-layer structure, so that the fusion destruction of the casing 10 is made difficult. The side wall 11 having a multi-layer structure will be described later in detail.

Each of the operation panels 15*a* and 15*b* functions as a display unit displaying a guide screen guiding a customer's operation or a customer operation unit detecting a customer's operation. Further, the front door 16 is a one-side opening type door, and is connected to the side wall 11 of the casing 10 through a hinge. In general, the front door 16 is opened or closed by a service person to conduct an internal check or the like, and money may be inserted into or extracted from the front surface of the casing 10.

Plural pins 12 are provided at an outer wall of the side wall 11. The pins 12 are stuck in the outer wall of the side wall 11. Further, an inner wall 14 is provided at an inner side of the side wall 11. A fusion-resistant material 13 is provided between the pins 12 and the inner wall 14.

The fusion-resistant material 13 mainly includes inorganic minerals, and is formed by paper-making molding, so that it has an excellent heat-resistant property. As the fusion-resistant material 13, for example, a deformable heat insulating material such as an asbestos sheet may be exemplified.

As shown in FIG. 2, the fusion-resistant material 13 is provided while being bent between the pins 12 and the inner wall 14. Further, the pins 12 are provided to bend the fusion-resistant material 13, and the pins 12 come into contact with the bent portions of the fusion-resistant material 13. Further, the inner wall 14 has protrusions coming into contact with the fusion-resistant material. The protrusions provided in the inner wall 14 may be partially provided. The protrusions of the inner wall 14 come into contact with the bent portions of the fusion-resistant material 13.

As described above, since the fusion-resistant material 13 may be deformable, the fusion-resistant material is shaped to be bent by the pins 12 and the protrusions of the inner wall 14.

As shown in FIG. 2, in the exemplary embodiment, the side wall 11 is provided at both side surfaces of the casing 10, but the invention is not limited to the example. For example, when one side surface of the casing 10 faces a wall outside of the casing 10, the side wall 11 may be provided only at the side surface of the casing 10 that does not face the wall. Further, the front door 16 may have the same configuration as that of the side wall 11.

Further, as shown in FIG. 3, the plural pins 12 may be provided on an inner face of the outer wall of the side wall 11. The plural pins 12 are provided with a predetermined interval therebetween. The plural pins 12 may be provided with the same interval therebetween as long as the fusion-resistant material 13 may be bent by the pins.

As shown in FIGS. 1 to 3, the side wall 11 includes the pins 12 provided on the outer wall, the fusion-resistant material 13, and the inner wall 14, but the invention is not limited to the example. The side wall 11 may be formed as a side wall having a double-layer structure in which the fusion-resistant material 13 is provided inside of the outer wall with a gap with respect to the outer wall. In this case, the fusion-resistant material 13 may be bent as described above, or may not be bent so that it is disposed in parallel to the outer wall of the side wall 11 with a predetermined gap therebetween.

Further, the side wall 11 may have a three-layer structure in which the fusion-resistant material 13 is provided inside of the outer wall of the side wall 11 with a gap with respect to the outer wall, and the inner wall 14 is provided inside of the fusion-resistant material 13 with a gap with respect to the fusion-resistant material. Even in this case, the fusion-resistant material 13 may be bent as described above, or may not be bent so that it is disposed in parallel to the outer wall of the side wall 11 with a predetermined gap therebetween. Further, the protrusions may be provided at the inner wall 14 as described above, or the inner wall without the protrusions may be disposed in parallel to the outer wall of the side wall 11 or the fusion-resistant material 13 with a predetermined gap therebetween.

In this manner, when the side wall 11 is formed as a double-layer structure by providing the fusion-resistant material 13 inside of the outer wall, the side wall 11 is not easily fused by a gas burner or the like. Further, the weight may be more reduced compared to the conventional casing having the side wall formed by laminating thick steel plates. Furthermore, since the side wall 11 is formed as a multi-layer structure by providing the fusion-resistant material or the inner wall with a gap with respect to the outer wall, when the side wall is fused by a gas burner or the like, it is difficult to judge whether the side wall 11 is cut and hence it may take more time for the fusion of the side wall.

Further, since the fusion-resistant material 13 is deformed, it is difficult to determine whether the side wall is cut, and hence it may take more time for the fusion of the side wall. Further, the amount of slag generated by the cutting of the side wall 11 becomes different depending on positions where the pin 12 is provided or not, and where the protrusion of the inner wall 14 is provided or not. Accordingly, it is more difficult to determine whether the side wall is cut, and hence it may take more time for the fusion of the side wall. Further, since the slag generated by the cutting is attached to the bent fusion-resistant material 13, the fusion work may become difficult to perform.

Additionally, since the amount of the slag attached to the bent fusion-resistant material 13, the pin 12, or the protrusion of the inner wall 14 is not constant, the fusion work may not be performed at a constant speed. For this reason, there is high possibility that erroneous fusion may be caused in which the cutting is not sufficiently performed.

Figure 4:
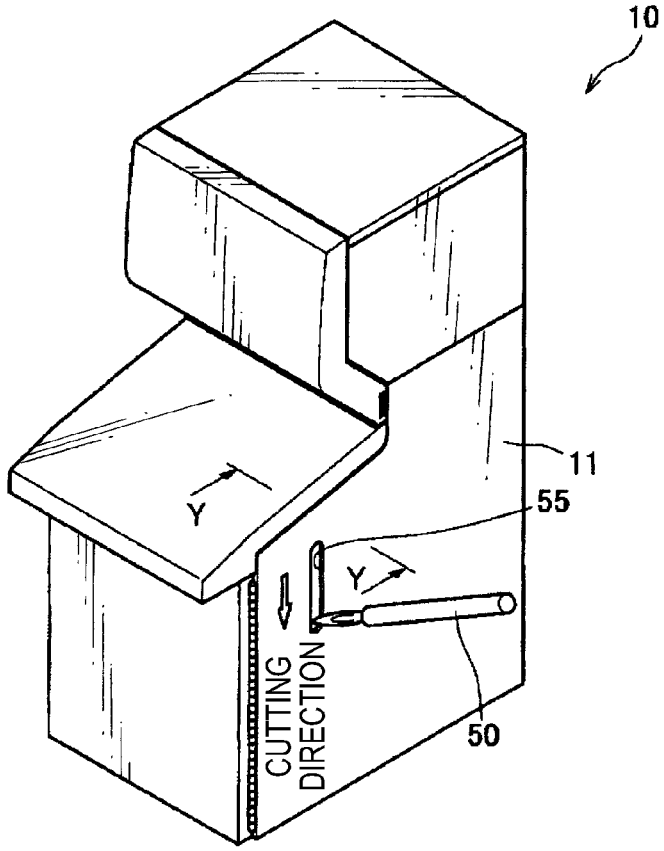
FIG. 4 is an explanatory diagram illustrating fusion destruction of the casing of the first exemplary embodiment.

Here, the fusion of the side wall 11 using a gas burner will be described by referring to FIGS. 4 and 5. FIG. 4 is an explanatory diagram illustrating the fusion of the side wall 11 using the gas burner. Further, FIG. 5 is a cross-sectional view taken along the line Y-Y of FIG. 4.

Figure 5:
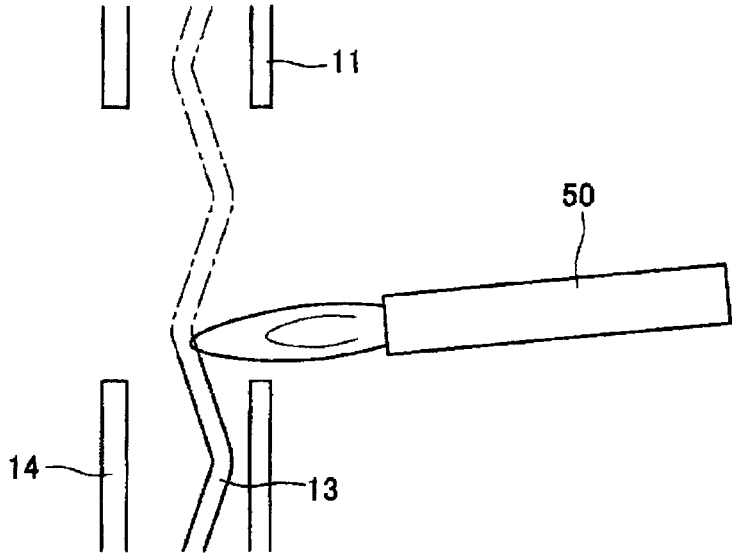
FIG. 5 is a cross-sectional view taken along the line Y-Y of FIG. 4 of the first exemplary embodiment.

As shown in FIG. 4 for example, in a case that the side wall 11 of the casing 10 is tried to be fused by a gas burner 50, as shown in FIG. 5, the outer wall of the side wall 11 is first fused by the gas burner 50, and the bent fusion-resistant material 13 is fused. Then, after the fusion-resistant material 13 is fused, the inner wall is further fused.

At this time, since the fusion-resistant material 13 is bent, it is difficult to perform fusing by moving the gas burner 50 up and down at a constant speed. As described above, when the pins 12 are provided at the outer wall of the side wall 11 or the protrusions are provided at the inner wall 14, it is more difficult to conduct fusing work by moving the gas burner 50 at a constant speed, and hence it is difficult to determine whether the fusion-resistant material is cut.

(2-2) Outline of Automatic Transaction System

Figure 6:
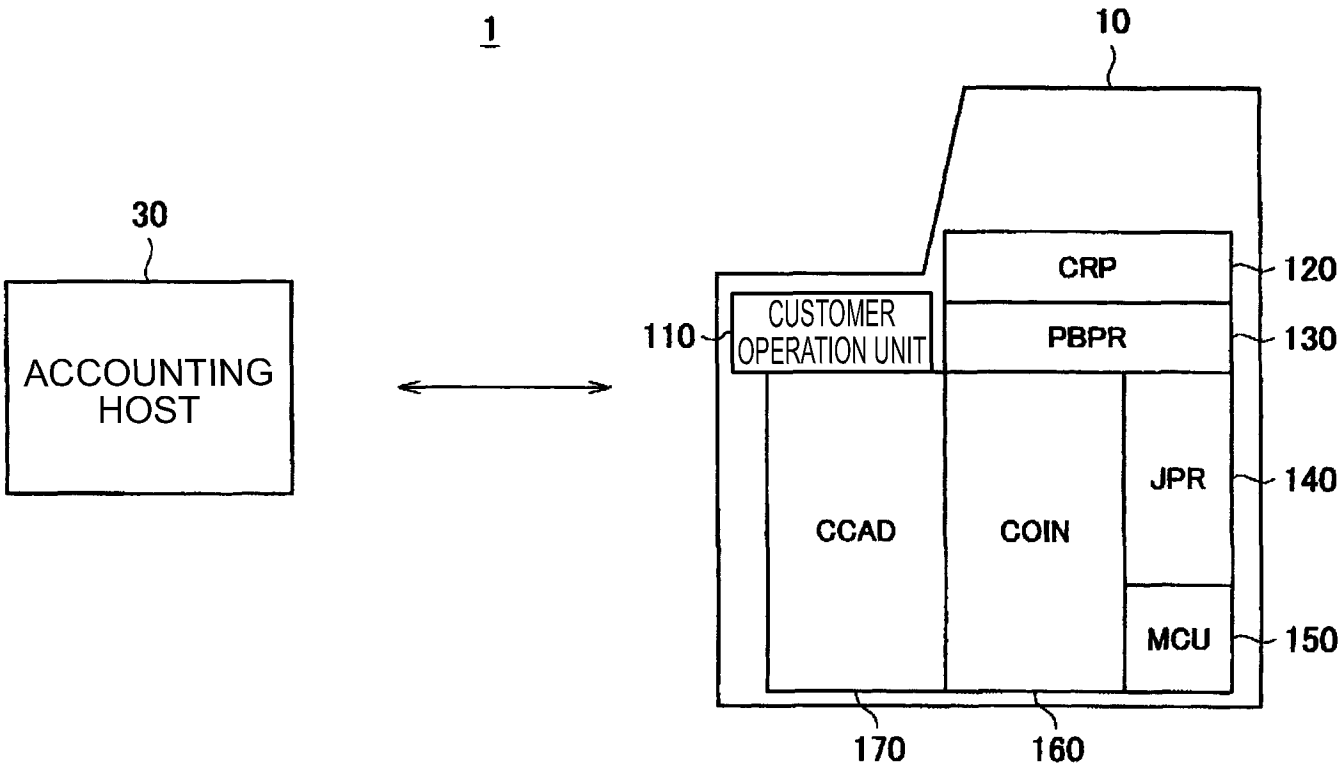
FIG. 6 is an explanatory diagram illustrating an outline of an automatic transaction system of the first exemplary embodiment.

As described above, the configuration of the casing 10 has been described. Next, the outline of an automatic transaction system 1 applying the casing 10 to the automatic teller machine will be described by referring to FIG. 6. FIG. 6 is an explanatory diagram illustrating the outline of the automatic transaction system 1. In FIG. 6, the casing 10 is applied to an automatic teller machine 10. As shown in FIG. 6, the automatic transaction system 1 includes the automatic teller machine 10, an accounting host 30, and the like.

In the exemplary embodiment, particularly, the automatic transaction system for using the automatic teller machine (ATM) of the bank is exemplified, but the invention is not limited to the example. As shown in FIG. 6, the automatic teller machine 10 includes a customer operation unit 110, a CRP 120, a PBPR 130, a JPR 140, a MCU 150, a COIN 160, and a CCAD 170.

The customer operation unit 110 has a function of a display unit displaying a guide screen guiding a customer's operation and a customer operation unit detecting a customer's operation, and is an example of the operation panels 15*a* and 15*b* of FIG. 1. The function of the display unit is realized by, for example, a cathode ray tube (CRT) display device, a liquid crystal display (LCD) device, and an organic light emitting diode (OLED) device. Further, the function of the customer operation unit is realized by, for example, a touch panel. Furthermore, in the specification, the functions of the display unit and the customer operation unit are integrated in the automatic teller machine 10, but the functions of the display unit and the customer operation unit may be separately provided.

The CRP 120 has functions of a magnetic card reader/writer and a receipt printer. Regarding the magnetic card reader/writer, the writing/reading is performed for the magnetic card inserted into the automatic teller machine 10. Further, regarding the receipt printer, the transaction receipt is printed after the traction is performed.

The PBPR 130 has a function printing a bankbook. The function includes reading a magnetic stripe provided in a bankbook inserted by a customer and printing a history on a bankbook. For example, the PBPR 130 may read customer identification information such as an account number from the magnetic stripe of the bankbook, and may write a transaction history of a customer obtained based on the customer identification information from the accounting host 30.

The JPR 140 has a function of a receipt journal printer, and outputs a receipt having transaction contents printed thereon. The MCU 150 has a function of a control unit controlling the automatic teller machine 10, and controls the communication with the accounting host 30 or data reading and the like.

The COIN 160 has a function of a coin depositing/withdrawing machine, and performs a coin depositing/withdrawing process. The CCAD 170 has a function of a bill depositing/withdrawing machine, and performs a bill depositing/withdrawing process. The depositing process indicates, for example, a process in which the type of a bill or a coin input into a depositing opening by a customer and the number thereof are identified, and a bill or a coin is stored in a predetermined place. Further, the withdrawing process indicates a process in which the number of bills or coins corresponding to the amount of money designated by a customer's operation is counted, and the bills or the coins are carried to the withdrawing opening.

Further, the automatic teller machine 10 includes a storage medium (not shown) that stores information. The storage medium stores, for example, a control program used to control the entire operation of the automatic teller machine 10, screen data used to be displayed on the customer operation unit 110, and information required for customer's transaction. Here, the storage medium includes, for example, a magnetic storage medium such as a hard disk or a non-volatile memory such as an electrically erasable and programmable read only memory (EEPROM), a flash memory, a magnetoresistive random access memory (MRAM), a ferroelectric random access memory (FeRAM), and a phase change random access memory (PRAM).

The accounting host 30 is connected to the automatic teller machine 10 via a network, and performs authentication of a customer operating the automatic teller machine 10, and money transaction (transaction process related to accounting) such as credit or transfer instructed by a customer to the automatic teller machine 10. Further, the accounting host 30 includes a database storing the customer information or a transaction history representing the contents of a money transaction previously performed by a customer. The accounting host 30 manages customer information (a master file of a bank account) such as an account number, a password, a name, an address, an age, a birth date, a telephone number, an occupation, a family member, an annual income, and a bank balance in the database. The accounting host 30 having the database functions as a managing server that performs a transaction with the automatic teller machine 10.

The network connecting the automatic teller machine 10 and the accounting host 30 to each other is a private network, that is, a network of a financial institution. The network includes, for example, an internet protocol-virtual private network (IP-VPN) and the like. As described above, the outline of the automatic transaction system 1 has been described.

(3) Second Exemplary Embodiment

As described above, the first exemplary embodiment has been described. Next, a casing 20 according to a second exemplary embodiment will be described by referring to FIGS. 7 to 9. The exemplary embodiment is different from the first exemplary embodiment in that a fusion-resistant material 23 and an inner wall 24 are attachably and detachably provided in a side wall 21. Hereinafter, this will be described in detail. Note that, in the exemplary embodiment, the side wall 21, a pin 22, the fusion-resistant material 23, the inner wall 24, operation panels 25*a* and 25*b*, and a front door 26 respectively have the same configurations as those of the side wall 11, the pin 12, the fusion-resistant material 13, the inner wall 14, the operation panels 15*a* and 15*b*, and the front door 16 of the first exemplary embodiment except for the above-described different point.

(3-1) Configuration of Casing

Figure 7:
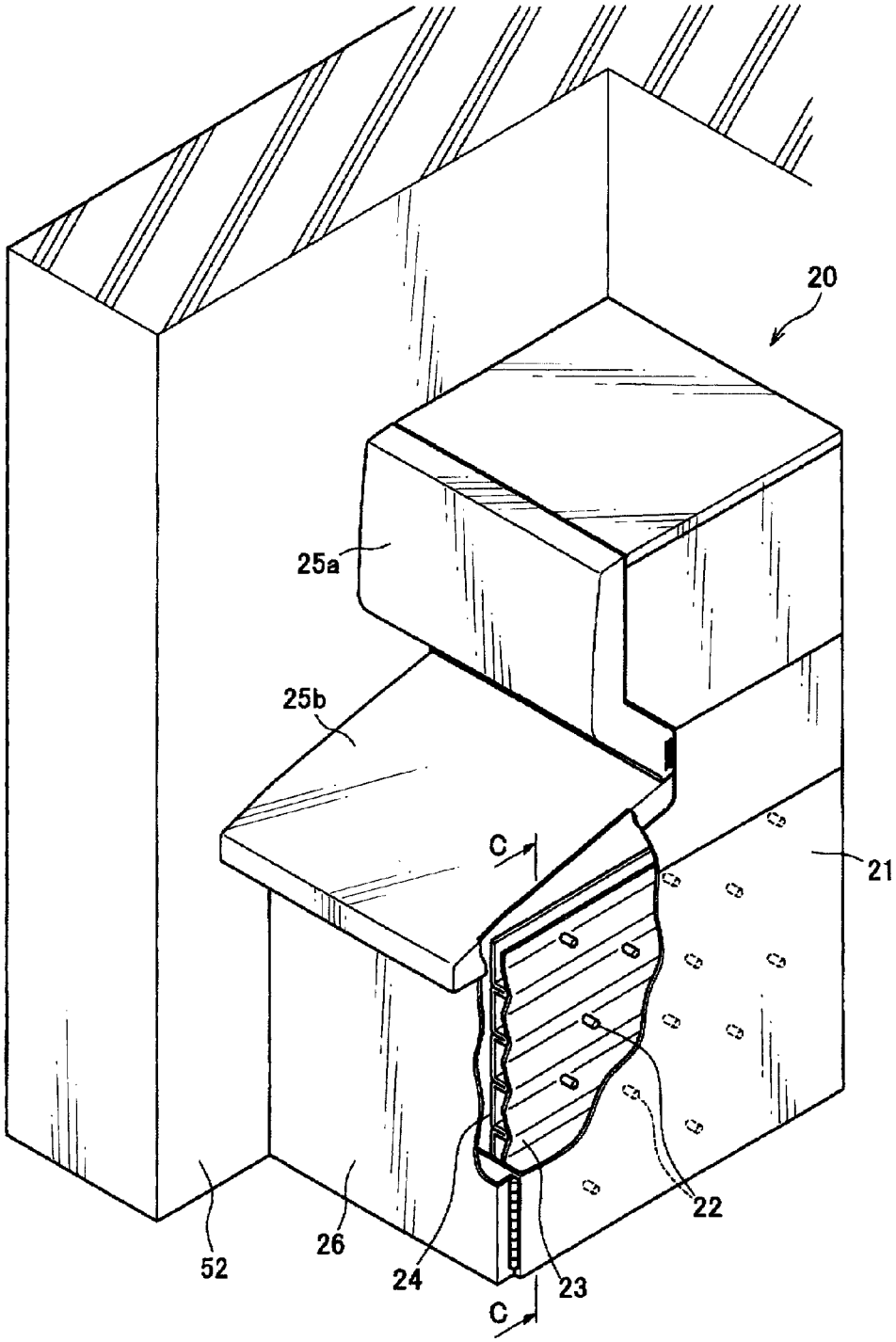
FIG. 7 is a perspective view schematically illustrating an external shape of a casing according to a second exemplary embodiment of the invention.
Figure 8:
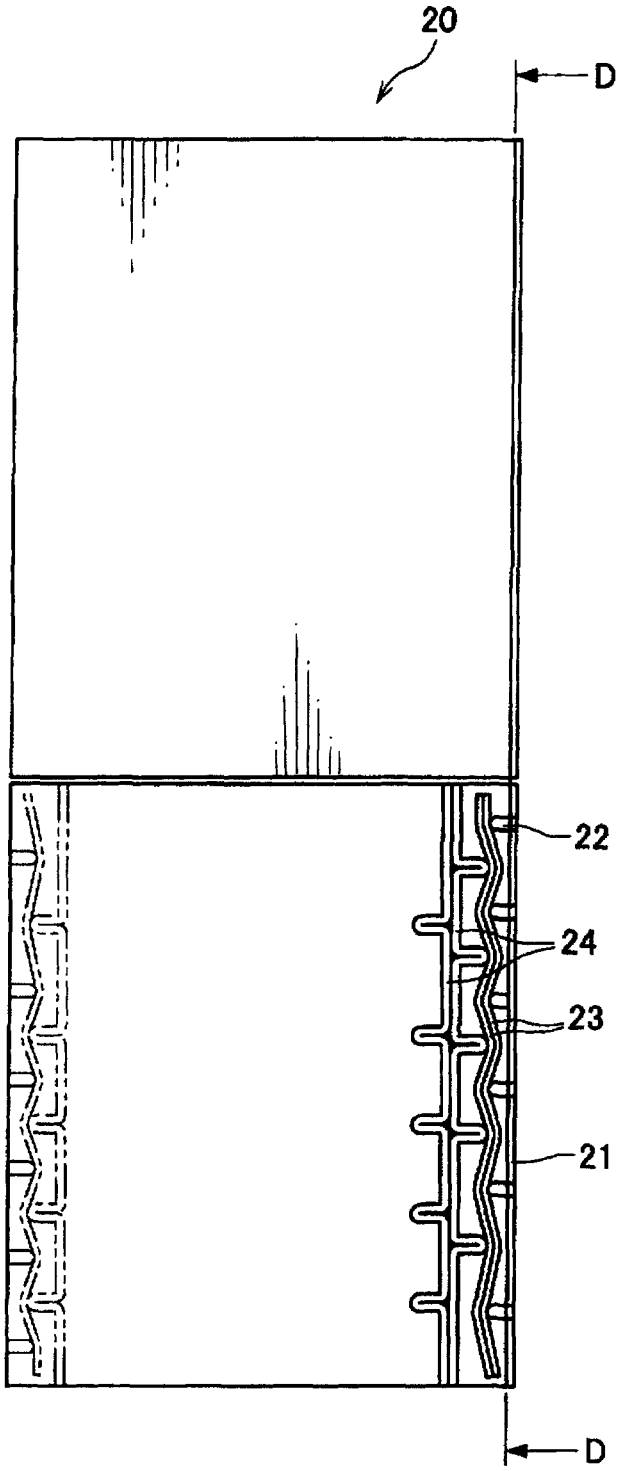
FIG. 8 is a cross-sectional view taken along the line C-C of FIG. 7 of the second exemplary embodiment.
Figure 9:
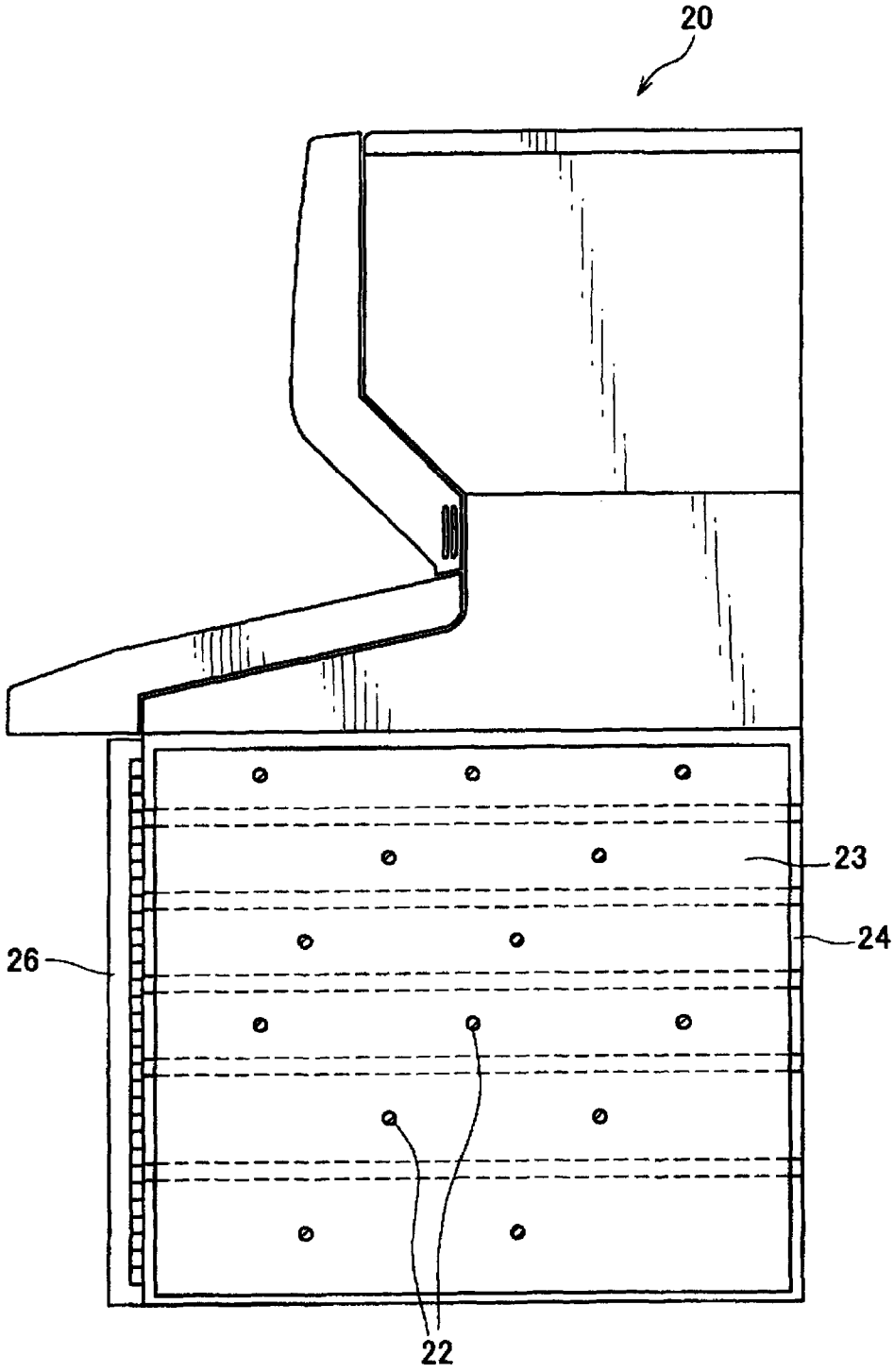
FIG. 9 is a cross-sectional view taken along the line D-D of FIG. 8 of the second exemplary embodiment.

FIG. 7 is a perspective view schematically illustrating the external shape of the casing 20. Further, FIG. 8 is a cross-sectional view taken along the line C-C of FIG. 7, and FIG. 9 is a cross-sectional view taken along the line D-D of FIG. 8. As shown in FIG. 7, in the exemplary embodiment, the casing 20 is installed by a wall 52 of a building so that the wall 52 of the building contacts the left side surface of the casing 20.

As described above, since the fusion-resistant material 23 and the inner wall 24 are attachably and detachably provided in the side wall 21 of the casing 20, the fusion-resistant material 23 and the inner wall 24 provided at the left side surface of the casing 20 may be moved to the right side wall 21. Accordingly, the fusion-resistant material 23 may be formed as a double-layer structure or the inner wall 24 may be formed as a double-layer structure.

Although not shown in the drawings, in a case that the casing 20 is installed so that the wall 52 of the building contacts the right side surface of the casing 20, the fusion-resistant material 23 and the inner wall 24 on the right side surface of the casing 20 may be moved to the left side surface thereof. Further, in FIG. 8, the fusion-resistant material 23 and the inner wall 24 are provided to be movable, but the invention is not limited to the example. For example, only the fusion-resistant material 23 may be moved, or only the inner wall 24 may be moved.

Even in the exemplary embodiment, only the fusion-resistant material 23 may be provided in the side wall 21, or only the inner wall 24 may be provided in the side wall 21. Further, the fusion-resistant material 23 may be bent as in the first exemplary embodiment, or may not be bent so that it is disposed in parallel to the outer wall of the side wall 21 with a predetermined gap therebetween. Further, the protrusion may be formed in the inner wall 24 as in the first exemplary embodiment, or the inner wall without the protrusion may be disposed in parallel to the outer wall of the side wall 21 or the fusion-resistant material 23 with a predetermined gap therebetween.

In this manner, when the fusion-resistant material 23 and the inner wall 24 are moved, the side wall 21 may be formed as a five-layer structure including the outer wall. Accordingly, a configuration which is more difficult to be fused is preferably formed compared to the first exemplary embodiment. Further, even when the side wall 21 is formed as a five-layer structure, since two layers within the five-layer structure are formed of the light fusion-resistant material 23 such as an asbestos sheet, the weight may be lighter compared to the conventional casing including the side wall formed by laminating the thick steel plates.

Further, since the side wall 21 is formed as a five-layer structure so that the fusion-resistant material 23 or the inner wall 24 is provided with a predetermine gap with respect to the outer wall, it is more difficult to determine whether the side wall 21 is cut when the side wall 21 is fused by a gas burner or the like compared to the first exemplary embodiment, and hence it takes more time for the fusion work of the side wall.

While exemplary embodiments of the invention have been specifically described above by referring to the accompanying drawings, it should be understood that these are exemplary of the invention and are not to be considered as limiting. It is apparent for the person skilled in the art to which the invention belongs that various modifications or corrections may be made without departing from the gist of the claims, and it is understood that these modifications or corrections are, of course, included in the technical scope of the invention.

The invention claimed is:

1. A casing, comprising:

a side wall having a multi-layer structure, and including:

an outer wall, and a sheet of fusion-resistant material provided substantially throughout an entire inner side of the outer wall, and having opposing first and second surfaces, the first surface facing the outer wall, and being separated from the outer wall by a gap over its entire area, the fusion-resistant material having a bent configuration so that the first surface has alternating projection portions and dent portions which face the outer wall, with a distance from the outer wall to the first surface of the fusion-resistant material at the respective dent portions being greater than a distance from the user to the first surface of the fusion-resistant material at the respective projection portions.

2. The casing of claim 1, further comprising:

an inner wall provided at an inner side of the fusion-resistant material.

3. The casing of claim 1, wherein the fusion-resistant material is formed of a heat insulating material.

4. The casing of claim 2, wherein the inner wall has a plurality of protrusions that contact with the fusion-resistant material.

5. The casing of claim 2, wherein a plurality of pins are provided on the inner side of the outer wall that contact with the fusion-resistant material.

6. The casing of claim 1, wherein the side wall is provided at both side surfaces of the casing.

7. The casing of claim 1, wherein the fusion-resistant material is attachably and detachably provided in the casing, and the fusion-resistant material provided at one side wail of the casing can be removed to be provided at the other side wall of the casing.

8. The casing of claim 2, wherein the inner watt is attachably and detachably provided in the casing, and the inner wall provided at one side wall of the casing can be removed to be provided at the other side wall of the casing.

9. The casing of claim 1, wherein the casing is used for an automatic transaction machine.

10. The casing of claim 1, wherein the fusion-resistant material is deformable.

11. The casing of claim 1, wherein the fusion-resistant material is an asbestos sheet.

12. The casing of claim 1, wherein the side wall further comprises a plurality of pins disposed on the inner side of the outer wall that contact the dent portions.

13. The casing of claim 1, wherein the second surface of the fusion-resistant material has alternating projection portions and dent portions which face away from the outer wall.

14. The casing of claim 13, the side wall further comprises an inner wall which faces the second surface of the fusion-resistant material, and which has a plurality of protrusions that contact the dent portions of the second surface.

* * * * *